US010994532B2

(12) United States Patent
Ishida et al.

(10) Patent No.: US 10,994,532 B2
(45) Date of Patent: May 4, 2021

(54) LIQUID DISCHARGE APPARATUS AND CONTROL METHOD THEREOF

(71) Applicant: CANON KABUSHIKI KAISHA, Tokyo (JP)

(72) Inventors: Yuzuru Ishida, Yokohama (JP); Maki Kato, Fuchu (JP); Yoshinori Misumi, Tokyo (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/570,361

(22) Filed: Sep. 13, 2019

(65) Prior Publication Data

US 2020/0086633 A1 Mar. 19, 2020

(30) Foreign Application Priority Data

Sep. 18, 2018 (JP) ..... JP2018-174187

(51) Int. Cl.
*B41J 2/14* (2006.01)
*B41J 2/045* (2006.01)

(52) U.S. Cl.
CPC ..... *B41J 2/04555* (2013.01); *B41J 2/0451* (2013.01); *B41J 2/0458* (2013.01); *B41J 2/04541* (2013.01); *B41J 2/14129* (2013.01)

(58) Field of Classification Search
CPC .... B41J 2/04555; B41J 2/0451; B41J 2/0458; B41J 2/14129; B41J 2/04541
See application file for complete search history.

(56) References Cited

U.S. PATENT DOCUMENTS

| | | | | |
|---|---|---|---|---|
| 6,582,045 | B2 | 6/2003 | Hirayama | |
| 9,096,059 | B2 | 8/2015 | Hatsui et al. | |
| 10,538,086 | B2 * | 1/2020 | Fujii | B41J 2/14072 |
| 2019/0299600 | A1 | 10/2019 | Nomura et al. | |

FOREIGN PATENT DOCUMENTS

| | | | |
|---|---|---|---|
| JP | 2014-124923 | A | 7/2014 |

* cited by examiner

*Primary Examiner* — Geoffrey S Mruk
(74) *Attorney, Agent, or Firm* — Venable LLP

(57) ABSTRACT

A liquid discharge apparatus includes a plurality of anti-cavitation layers formed to cover heat generating elements at positions where the anti-cavitation layers contact the liquid, a monitoring unit that detects a current flowing through the anti-cavitation layers, and a plurality of switching units that switch whether to apply, to the heat generating elements, a voltage for driving the heat generating elements. If the monitoring unit detects that a current greater than a predetermined value has flowed through one of the anti-cavitation layers while the voltage is applied to the heat generating elements, a control unit sequentially switches the plurality of switching units, and specifies the heat generating element corresponding to the anti-cavitation layer through which the current has flowed, among the heat generating elements.

9 Claims, 7 Drawing Sheets

LIQUID DISCHARGE APPARATUS AND CONTROL METHOD THEREOF

BACKGROUND OF THE INVENTION

Field of the Invention

The present invention relates to a liquid discharge apparatus and a control method thereof.

Description of the Related Art

Conventionally, a type of liquid discharge apparatus heats a liquid in a liquid chamber by energizing a heat generating element, causes film boiling of the liquid, and discharges a droplet from an orifice by bubbling energy at this time. In a liquid discharge printing apparatus of this type, a physical action of impact by cavitation generated when a liquid bubbles and the bubbles shrink and disappear is sometimes exerted on an area on the heat generating element. To protect the heat generating element from the physical action or a chemical action on the heat generating element, an anti-cavitation layer formed from a metal material is sometimes arranged on the heat generating element. To insulate the heat generating element and the anti-cavitation layer from each other, an insulation layer is arranged between the heat generating element and the anti-cavitation layer.

The function of the insulation layer may be impaired by some cause (random failure) to generate a short circuit in which electricity flows directly from the heat generating element or the wiring into the anti-cavitation layer. If part of the electricity supplied to the heat generating element flows into the anti-cavitation layer, an electrochemical reaction occurs between the anti-cavitation layer and the liquid and the anti-cavitation layer may be changed in quality or eluted. When the anti-cavitation layer is arranged over a plurality of liquid chambers, the current flows into other liquid chambers via the anti-cavitation layer and influences the anti-cavitation layer inside the other liquid chambers.

A measure against the random failure of the heat generating element may be a breaking portion (fuse) provided in part of the anti-cavitation layer. When a current flows into the anti-cavitation layer, the electrical connection can be broken at the breaking portion to prevent the flow of the current into other liquid chambers. Japanese Patent Laid-Open No. 2014-124923 discloses the arrangement of a head in which an anti-cavitation layer includes individual portions provided in correspondence with respective heat generating elements and a common portion connected commonly to a plurality of individual portions. The individual portions and the common portion include a fuse conductive layer made of a material lower in melting point than the material of the anti-cavitation layer.

However, even the arrangement including the breaking portion as in Japanese Patent Laid-Open No. 2014-124923 does not guarantee to reliably disconnect the breaking portion (fuse). When the contact between the heat generating element and the anti-cavitation layer is small and the contact resistance is high, a current flowing through the breaking portion is small and the fuse may not be disconnected.

SUMMARY OF THE INVENTION

The present invention can suppress, even when a heat generating element is damaged by a random failure in a pattern in which a plurality of anti-cavitation layers are connected, the influence on a peripheral portion.

According to one aspect of the present invention, there is provided a liquid discharge apparatus comprising: a plurality of heat generating elements configured to heat a liquid in order to discharge the liquid; a plurality of anti-cavitation layers formed to cover the heat generating elements at positions where the anti-cavitation layers contact the liquid; a monitoring unit configured to detect a current flowing through the anti-cavitation layers; a switching unit configured to switch whether to apply, to the heat generating elements, a voltage for driving the heat generating elements; and a control unit configured to send a signal to the switching unit and control switching of the switching unit, wherein if the monitoring unit detects that a current larger than a predetermined value has flowed through the anti-cavitation layer while the voltage is applied to the heat generating elements, the control unit sends, to the switching unit, a signal for switching the switching unit not to apply the voltage to the heat generating element corresponding to the anti-cavitation layer through which the current larger than the predetermined value has flowed, among the heat generating elements, the switching unit includes a plurality of switching units, and if the monitoring unit detects that the current larger than the predetermined value has flowed through the anti-cavitation layer while the voltage is applied to the heat generating elements, the control unit sequentially switches the plurality of switching units, and specifies the heat generating element corresponding to the anti-cavitation layer through which the current has flowed, among the heat generating elements.

According to another aspect of the present invention, there is provided a method of controlling a liquid discharge apparatus including: a plurality of heat generating elements configured to heat a liquid in order to discharge the liquid; a plurality of anti-cavitation layers formed to cover the heat generating elements at positions where the anti-cavitation layers contact the liquid; a monitoring unit configured to detect a current flowing through the anti-cavitation layers; a switching unit configured to switch whether to apply, to the heat generating elements, a voltage for driving the heat generating elements; and a control unit configured to send a signal to the switching unit and control switching of the switching unit, the method comprising: if the monitoring unit detects that a current larger than a predetermined value has flowed through the anti-cavitation layer while the voltage is applied to the heat generating elements, causing the control unit to control switching of the switching unit not to apply the voltage to the heat generating element corresponding to the anti-cavitation layer through which the current larger than the predetermined value has flowed, among the heat generating elements, the switching unit including a plurality of switching units; and if the monitoring unit detects that the current larger than the predetermined value has flowed through the anti-cavitation layer while the voltage is applied to the heat generating elements, causing the control unit to sequentially switch the plurality of switching units, and specify the heat generating element corresponding to the anti-cavitation layer through which the current has flowed, among the heat generating elements.

According to the present invention, even when a heat generating element is damaged by a random failure in a pattern in which a plurality of anti-cavitation layers are connected, the influence on a peripheral portion can be suppressed.

Further features of the present invention will become apparent from the following description of exemplary embodiments (with reference to the attached drawings).

DESCRIPTION OF THE EMBODIMENTS

Figure 1:
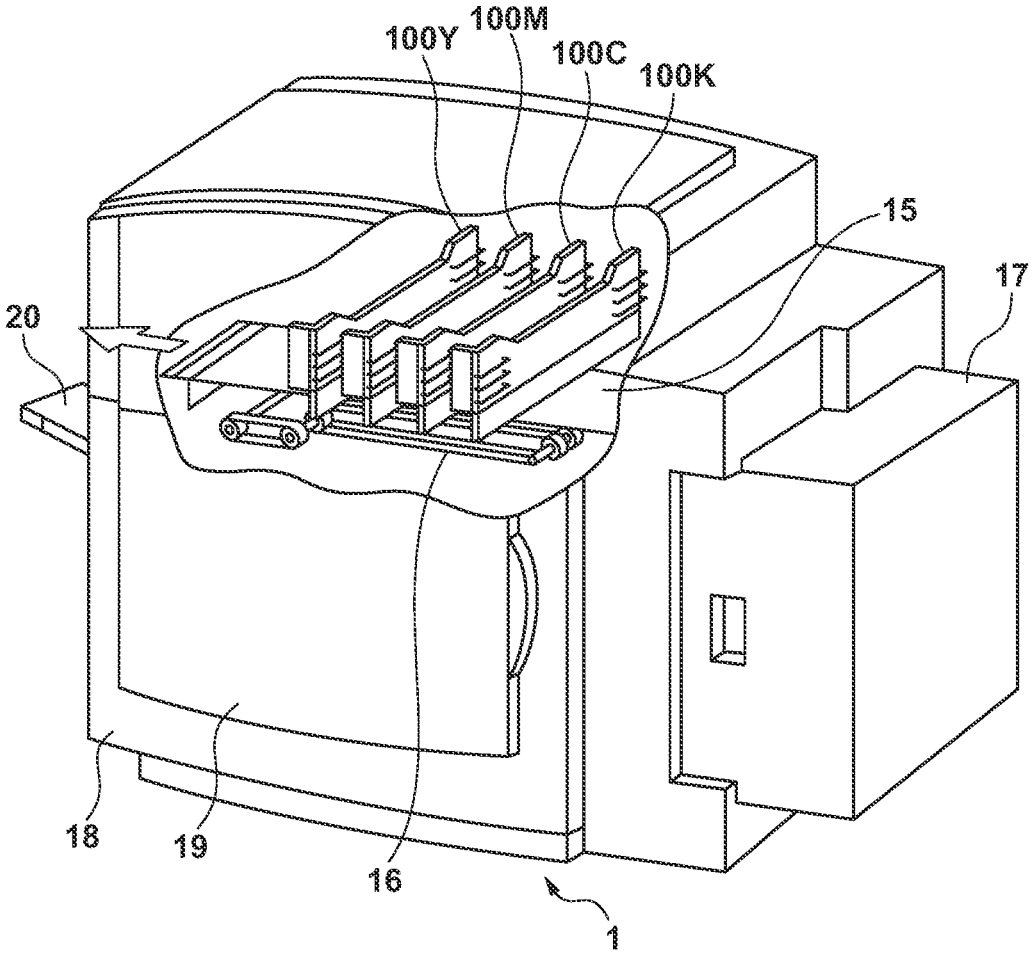
FIG. 1 is a view showing the schematic arrangement of a liquid discharge apparatus.

Preferred embodiments of the present invention will now be described in more detail with reference to the accompanying drawings. The relative arrangement of constituent elements and the like described here may not be construed to limit the scope of the present invention to only them unless otherwise specified.

In this specification, the term "printing" (to be also referred to as "print" hereinafter) not only includes the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

In addition, the term "print medium" not only includes a paper sheet used in common image forming apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be extensively interpreted to be similar to the definition of "printing (print)" described above. That is, "ink" includes a print material such as a liquid which, when applied onto a print medium, can form images, figures, patterns, and the like, can process the print medium, or can process ink (for example, solidify or insolubilize a coloring material contained in ink applied to the print medium).

Further, a "print element" generically means an orifice or a liquid channel communicating with it, and an element for generating energy used to discharge ink, unless otherwise specified.

Further, a "nozzle" generically means an orifice or a liquid channel communicating with it, unless otherwise specified.

A printhead element substrate (head substrate) used below means not merely a base made of a silicon semiconductor, but the arrangement of a printhead element substrate in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

A liquid discharge head (printhead) according to the present invention is constituted by mounting, on the same substrate, a plurality of print elements on the element substrate of the liquid discharge head and a driving circuit for driving these print elements. As will be apparent from the following description, the liquid discharge head adopts a structure in which a plurality of element substrates are incorporated and cascade-connected. This liquid discharge head can achieve a relatively long printing width. The liquid discharge head is used not only in a general-purpose serial liquid discharge apparatus but also in a liquid discharge apparatus with a full-line liquid discharge head whose printing width corresponds to the width of a print medium. The printhead is used in a large-format printer using print media of large sizes such as AO and BO among serial printing apparatuses.

First, a liquid discharge apparatus using a liquid discharge head according to the present invention will be described. This liquid discharge apparatus is, for example, an inkjet image forming apparatus.

[Overview of Liquid Discharge Apparatus]

FIG. 1 is a perspective view for explaining the structure of a liquid discharge apparatus 1 which includes full-line inkjet liquid discharge heads (to be simply referred to as liquid discharge heads hereinafter) 100K, 100C, 100M, and 100Y and a recovery unit for always guaranteeing stable ink discharge.

In the liquid discharge apparatus 1, a printing medium 15 is supplied from a feeder unit 17 to print positions for these liquid discharge heads and conveyed by a conveyance unit 16 provided in a housing 18 of the liquid discharge apparatus 1.

In printing an image on the printing medium 15, the printing medium 15 is conveyed. When the reference position of the printing medium 15 reaches a position under the liquid discharge head 100K configured to discharge black (K) ink, the liquid discharge head 100K discharges the black ink. Similarly, when the printing medium 15 reaches respective reference positions in the order of the liquid discharge head 100C configured to discharge cyan (C) ink, the liquid discharge head 100M configured to discharge magenta (M) ink, and the liquid discharge head 100Y configured to discharge yellow (Y) ink, the inks of the respective colors are discharged to form a color image. The printing medium 15 on which the image is thus printed is discharged and stacked on a stacker tray 20.

The liquid discharge apparatus 1 further includes ink cartridges (not shown) configured to supply the inks to the liquid discharge heads 100K, 100C, 100M, and 100Y and to be replaceable for each ink. In addition, the liquid discharge apparatus 1 includes, for example, a pump unit (not shown) for a recovery operation and ink supply to each of the liquid discharge heads 100, and a control board (not shown) that controls the overall liquid discharge apparatus 1. A front door 19 is an opening/closing door for replacing the ink cartridge.

[Control Arrangement]

Next, a control arrangement for executing print control of the liquid discharge apparatus 1 described with reference to FIG. 1 will be explained.

Figure 2:
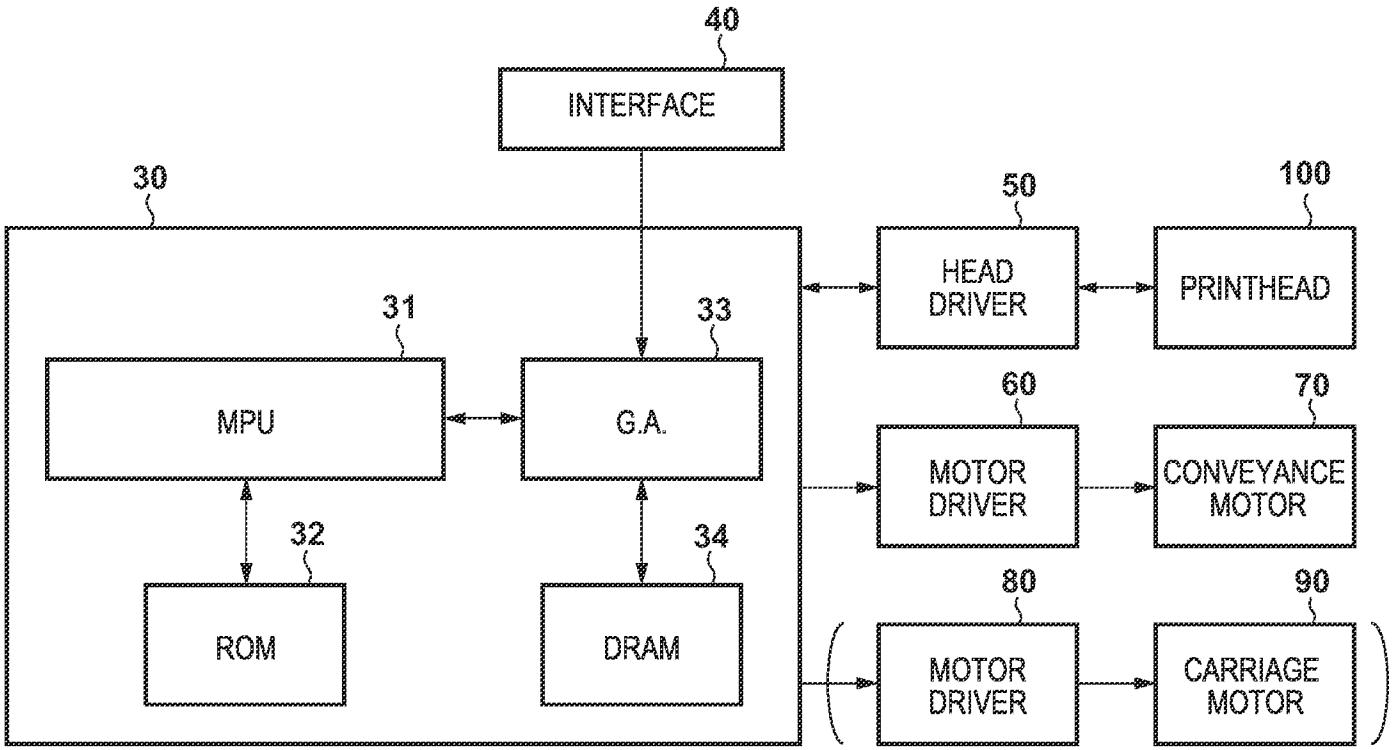
FIG. 2 is a block diagram showing an example of the arrangement of the control circuit of the liquid discharge apparatus.

FIG. 2 is a block diagram showing the arrangement of the control circuit of the liquid discharge apparatus 1. In FIG. 2, a controller 30 includes an MPU 31, a ROM 32, a gate array (G.A.) 33, and a DRAM 34. An interface 40 is an interface for inputting print data. The ROM 32 is a non-volatile storage area and stores a control program executed by the MPU 31. The DRAM 34 is a DRAM for saving data such as print data and print signals to be supplied to the liquid discharge heads 100. The gate array 33 is a gate array for controlling supply of print signals to the liquid discharge heads 100, and also controlling data transfer among the interface 40, the MPU 31, and the DRAM 34. A carriage motor 90 is a motor for conveying the liquid discharge heads 100. A conveyance motor 70 is a motor for conveying a print sheet. A head driver 50 drives the liquid discharge heads 100. Motor drivers 60 and 80 are motor drivers for driving the conveyance motor 70 and the carriage motor 90, respectively.

Note that a liquid discharge apparatus configured to use full-line liquid discharge heads as shown in FIG. 1 adopts neither the carriage motor 90 nor the motor driver 80 for driving the motor. Hence, the motor driver 80 and the carriage motor 90 are parenthesized in FIG. 2.

The operation of the above control arrangement will be explained. When print data is input to the interface 40, it is converted into a print signal for printing between the gate array 33 and the MPU 31. Then, simultaneously with driving of the motor drivers 60 and 80, the liquid discharge heads 100 are driven in accordance with the print data sent to the head driver 50, thereby performing printing.

The following embodiment is applicable to both a full-line liquid discharge head and a liquid discharge head for a serial liquid discharge apparatus.

[Arrangement of Liquid Discharge Head]

Figure 3:
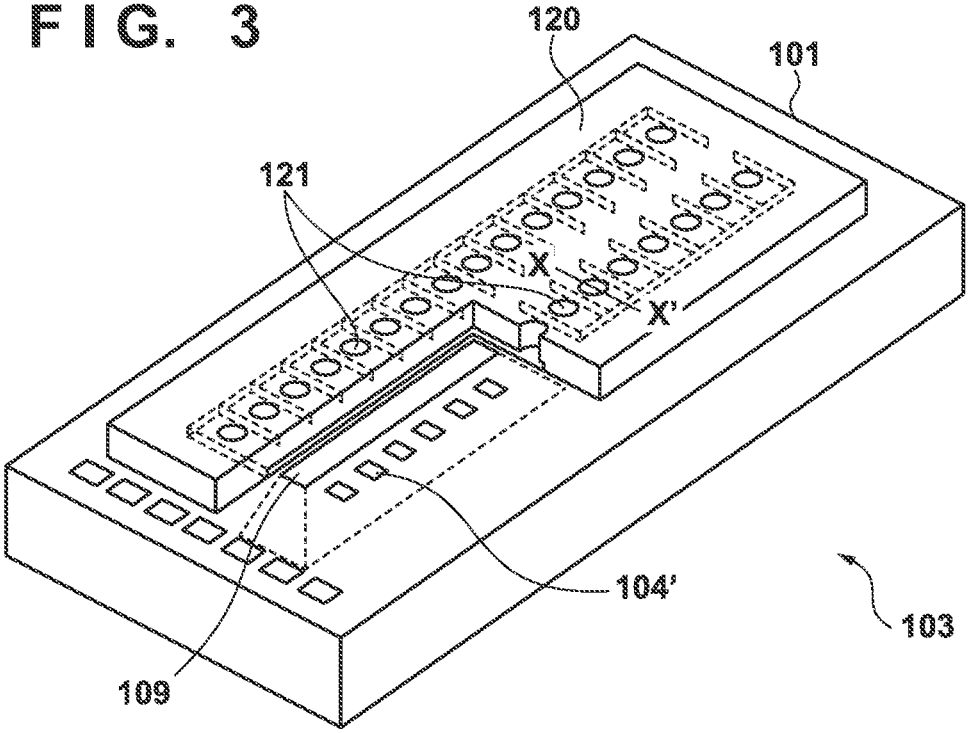
FIG. 3 is a perspective view of a printing element substrate according to an embodiment.
Figure 4:
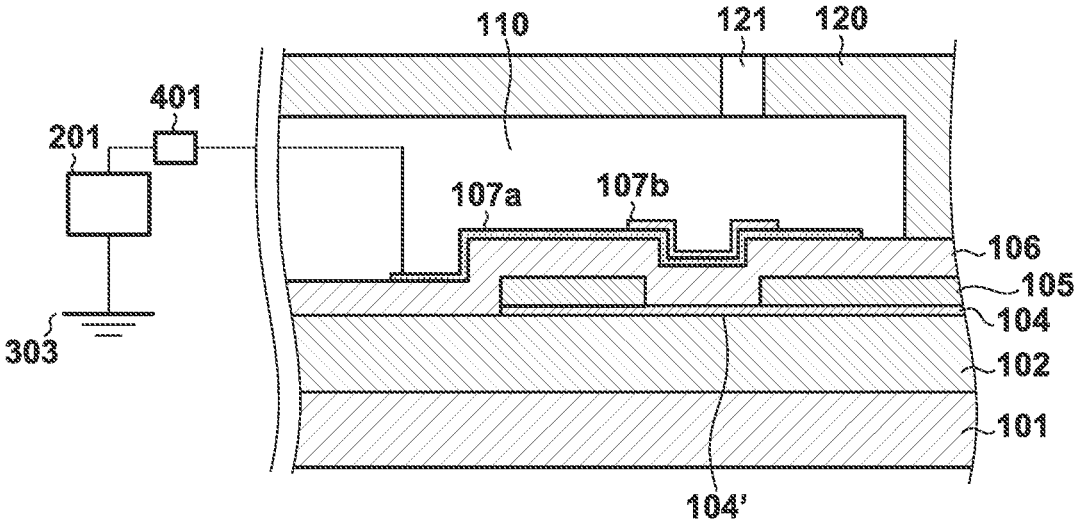
FIG. 4 is a sectional view of the printing element substrate according to the embodiment.

FIG. 3 is a perspective view showing a printing element substrate 103 according to this embodiment. The printing element substrate 103 is provided in the liquid discharge head 100. FIG. 4 is a schematic view of a section taken along a line X-X' in FIG. 3.

As shown in FIGS. 3 and 4, the printing element substrate 103 of the liquid discharge head 100 is formed by stacking a plurality of layers on a substrate 101 formed from silicon. In this embodiment, a heat storage layer 102 formed from a thermal oxide film, an SiO (silicon monoxide) film, an SiN (silicon nitride) film, or the like is arranged on the substrate 101. A heat generating element layer 104 is arranged on the heat storage layer 102. The heat generating element layer 104 is formed from TaSiN or the like to a thickness of about 50 nm. An electrode wiring layer 105 serving as wiring formed from a metal material such as Al (aluminum), Al—Si (aluminum-silicon alloy), or Al—Cu (aluminum-copper alloy) is arranged on the heat generating element layer 104. An insulation protection layer 106 is arranged on the electrode wiring layer 105. The insulation protection layer 106 is provided on the heat generating element layer 104 and the electrode wiring layer 105 at a thickness of 350 nm to cover them. The insulation protection layer 106 is formed from an SiO film, an SiN film, or the like. Orifices 121, a liquid chamber 110, and a channel forming member 120 are formed above the insulation protection layer 106.

An upper protection layer 107 is arranged on the insulation protection layer 106. The upper protection layer 107 protects the surfaces of heat generating elements 104' from chemical and physical impacts accompanying heat generation of the heat generating elements 104'. As shown in FIG. 4, the upper protection layer 107 includes an upper protection layer 107*a* formed to cover the insulation protection layer 106 in a wide range including a position corresponding to each orifice 121, and an upper protection layer 107*b* serving as an upper layer of the upper protection layer 107*a* and formed at the position corresponding to the orifice 121 (heat generating element 104'). In this embodiment, the upper protection layer 107 is formed from the platinum group such as iridium (Ir) or ruthenium (Ru), or tantalum (Ta). The upper protection layer 107 formed from such a material is conductive. The upper protection layer 107*a* is formed from, for example, Ta to a thickness of 100 nm. The upper protection layer 107*b* is formed from, for example, a material excellent in anti-cavitation to a thickness of 100 nm. When a liquid is discharged, the top of the upper protection layer 107 contacts the liquid in a harsh environment in which bubbles generated by an instantaneous rise of the liquid temperature at the top of the upper protection layer 107 disappear and cause cavitation. In this embodiment, the upper protection layer 107*b* formed from a material high in impact resistance and reliability is formed at the position corresponding to the heat generating element 104'. Although the upper protection layer 107*b* is formed from a material higher in impact resistance and reliability than the upper protection layer 107*a* in this embodiment, a combination of materials forming the upper protection layer 107 is not particularly limited.

The heat generating element 104' serving as an electrothermal transducer is formed by partially removing the electrode wiring layer 105 formed on the heat generating element layer 104. In this embodiment, the heat generating element layer 104 and the electrode wiring layer 105 are overlapped and arranged in almost the same shape in a direction from a liquid supply port 109 toward the liquid chamber 110. The heat generating element 104' is formed by partially removing the electrode wiring layer 105. The electrode wiring layer 105 is connected to a driving element circuit or an external power supply terminal (neither is shown in FIG. 4) and can receive supply of power from the outside.

Although the electrode wiring layer 105 is arranged on the heat generating element layer 104 in this embodiment, the present invention is not limited to this. An arrangement may be adopted in which the electrode wiring layer 105 is formed on the substrate 101 or the heat storage layer 102, part of the electrode wiring layer 105 is removed to form a gap, and the heat generating element layer 104 is arranged on the electrode wiring layer 105.

The upper protection layer 107 formed inside the liquid chamber 110 of a liquid (ink) is arranged like a band to cover the top of the heat generating element 104', and is designed so that a potential can be applied from outside the substrate 101 in order to control the surface potential of the upper protection layer 107. In this embodiment, the surface potential of the upper protection layer 107 is controlled to be a GND potential (ground potential) at the time of normal ink discharge. The upper protection layer 107 is connected to a current monitor 201 via an external connection terminal 401. Details of this arrangement will be described later.

Figure 7:
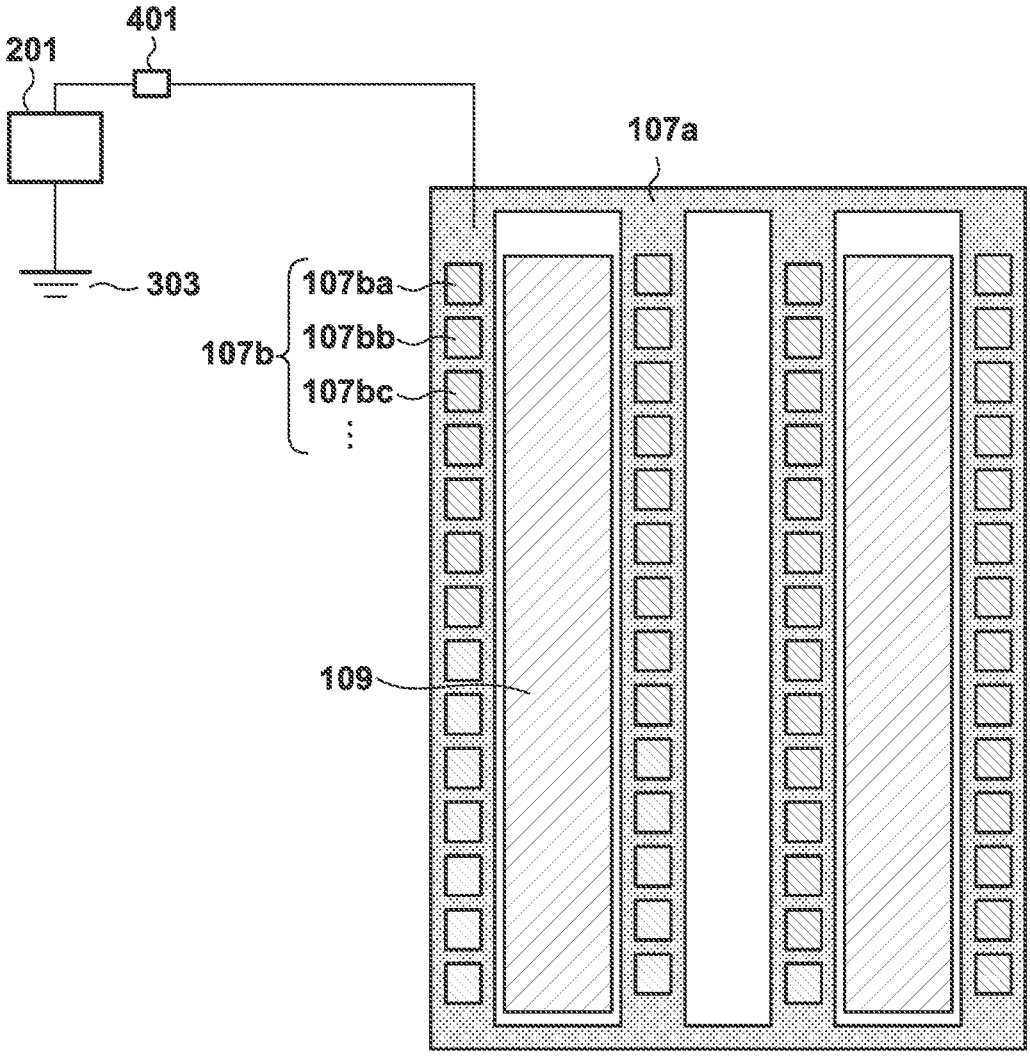
FIG. 7 is a plan view of the printing element substrate according to the embodiment.

FIG. 7 is a schematic view showing a plan view when the illustration of the channel forming member 120 (FIG. 4) of the printing element substrate according to this embodiment is omitted. A plurality of heat generating elements 104' (not shown) are arranged on the two sides of each liquid supply port 109, and the upper protection layers 107*b* serving as anti-cavitation layers are arranged on only the heat generating elements 104'. As shown in FIG. 4, the upper protection layer 107*a* is connected to a GND terminal 303 via the external connection terminal 401 and the current monitor 201 arranged outside the printing element substrate 103.

[Circuit Arrangement for Driving Heat Generating Element]

Figure 5:
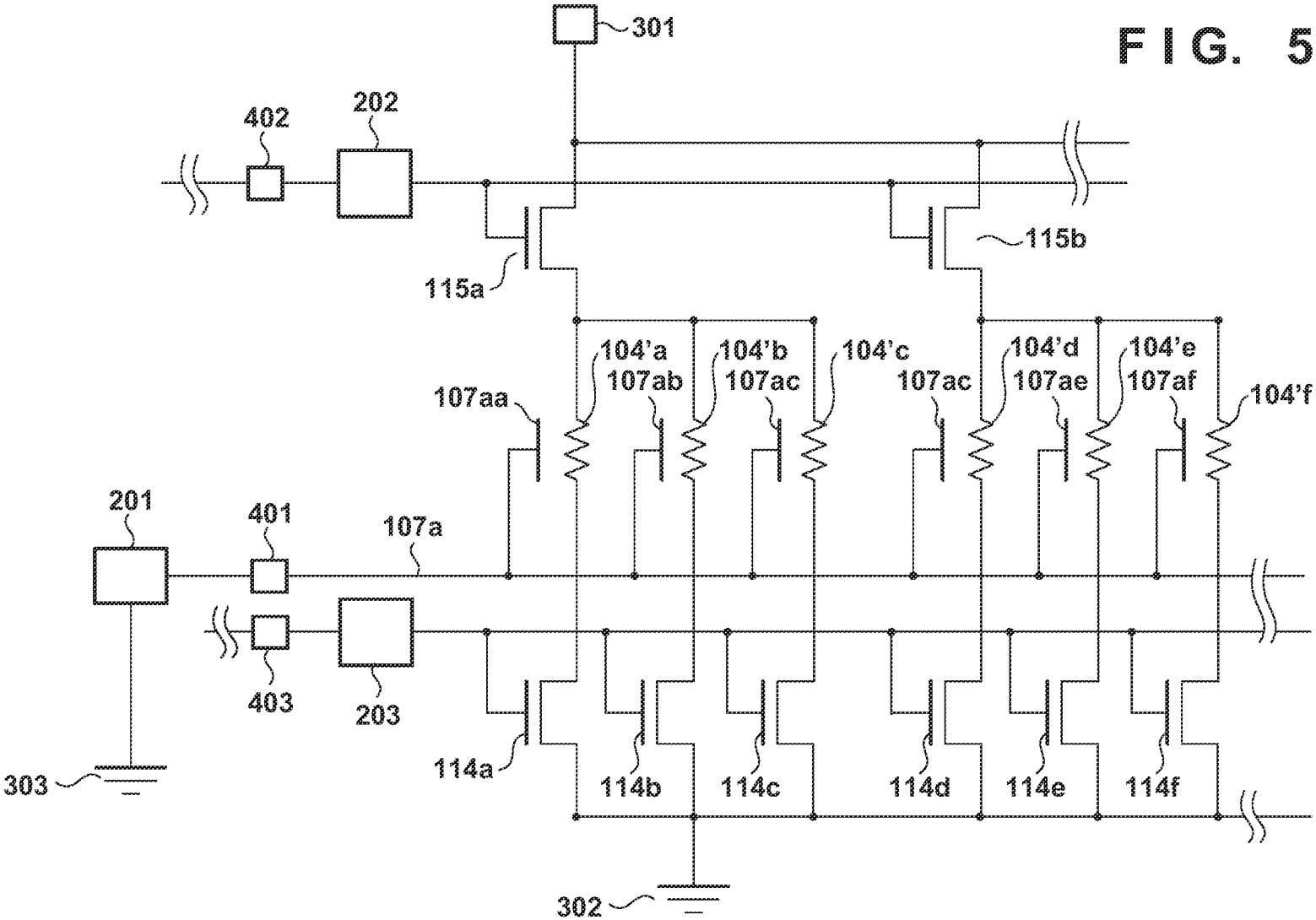
FIG. 5 is a circuit diagram of the printing element substrate according to the embodiment.

Next, the arrangement of a circuit for driving the heat generating element of the liquid discharge head 100 will be described as a feature of the present invention with reference to FIG. 5. FIG. 5 shows a circuit arrangement for driving the heat generating element of the liquid discharge head 100 according to this embodiment. As shown in FIG. 3, a plurality of heat generating elements 104' are formed in the liquid discharge head 100. When the heat generating elements 104' are explained collectively, the heat generating elements are denoted as 104'. When one heat generating element is explained individually, a suffix is added to the reference numeral. This also applies to other constituent elements.

Each heat generating element 104' is connected to a power supply 301 and the GND potential (a GND terminal 302). A driving voltage supply transistor 115 is interposed between the heat generating element 104' and the power supply 301. An image formation switching transistor 114 is interposed between the heat generating element 104' and the GND terminal 302. The driving voltage supply transistor 115 selectively switches application of a voltage from the power supply 301 to the heat generating element 104' based on a signal from a driving voltage supply selecting circuit 202. That is, the driving voltage supply transistor 115 is a switching unit having a function equivalent to ON/OFF of a switch in accordance with whether to apply a voltage to the heat generating element 104'. The image formation switching transistor 114 selectively switches driving of image formation by the heat generating element 104' based on a signal from an image formation selecting circuit 203. The driving voltage supply selecting circuit 202 accepts a signal from the outside via an external connection terminal 402. Based on this signal, the driving voltage supply selecting circuit 202 performs control to select the driving voltage supply transistor 115 to be driven among a plurality of driving voltage supply transistors 115. The image formation selecting circuit 203 accepts a signal from the outside via an external connection terminal 403. Based on this signal, the image formation selecting circuit 203 performs control to select the image formation switching transistor 114 to be driven among the image formation switching transistors 114 installed in correspondence with the respective heat generating elements 104'. Here, "the outside" is, for example, the main body side of the liquid discharge apparatus 1. At the time of normal image formation, the driving voltage supply transistor 115 is always ON. At the time of a random failure to be described later, the driving voltage supply transistor 115 is turned off to stop supply of a power supply voltage to the heat generating element 104'.

Although one driving voltage supply transistor 115 controls application (connection) of a voltage to three heat generating elements 104' in FIG. 5, the present invention is not limited to this arrangement. The correspondence between one driving voltage supply transistor 115 and the heat generating elements 104' may be one to one or one to N (N>1). In contrast, the image formation switching transistor 114 and the heat generating element 104' are provided in one-to-one correspondence. In this embodiment, the power supply 301 supplies a driving voltage of 15 to 40 V. Note that this embodiment adopts a 24-V power supply as the power supply 301. The power supply 301 may be provided on the main body side of the liquid discharge apparatus 1 or provided on the liquid discharge head 100 side. When the power supply 301 is provided on the liquid discharge head 100 side, for example, a voltage supplied from the main body side of the liquid discharge apparatus 1 may be adjusted on the liquid discharge head 100 side.

[Arrangement of Surface Potential Control Circuit]

This embodiment employs an arrangement in which a potential can be applied from outside the substrate via the external connection terminal 401 so as to control the surface potential of the upper protection layer 107. In this embodiment, the upper protection layer 107 is configured to be able to switch the connection to the GND potential (GND terminal 303). Since installing many external connection terminals 401 is difficult due to the substrate layout, the upper protection layer 107 is connected within the substrate 101 and connected to the outside via one or more external connection terminals 401. A circuit (to be described as the current monitor 201 hereinafter) serving as a monitoring unit for detecting a current flowing from the upper protection layer 107 to the GND terminal 303 is provided on the apparatus main body side of the liquid discharge apparatus 1. A detection result obtained by the current monitor 201 is used by, for example, the MPU 31 provided on the main body side of the liquid discharge apparatus 1. The MPU 31 uses the detection result to output a signal for controlling switching of each switching transistor. That is, the MPU 31 has the function of a control unit for controlling switching of the driving voltage supply transistor 115 in this embodiment.

[Behavior upon Random Failure]

Figure 6B:
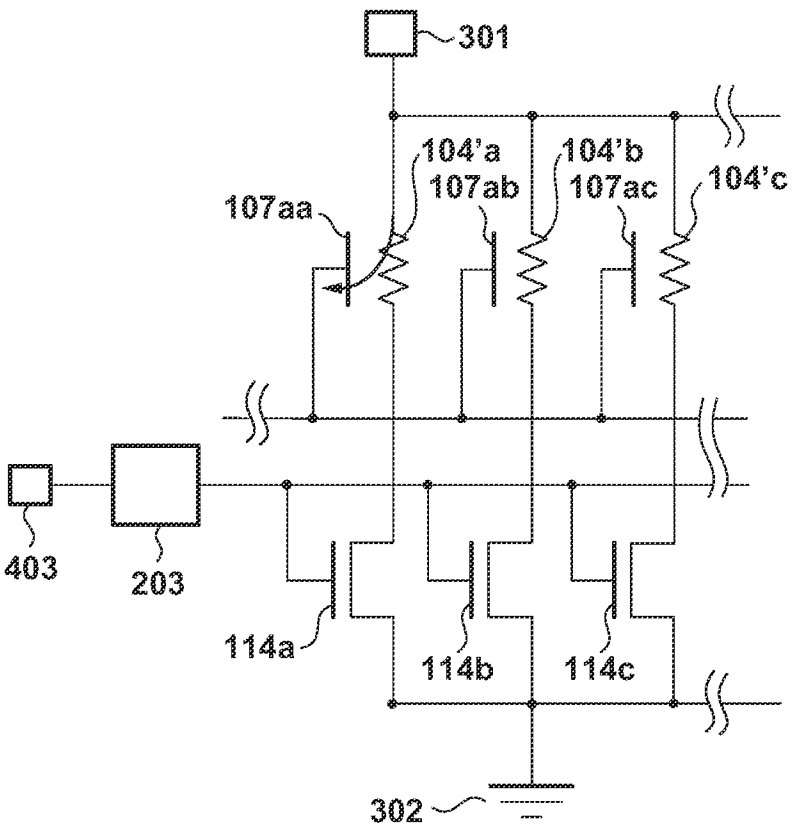
FIGS. 6A and 6B are circuit diagrams of a conventional printing element substrate.
Figure 6A:
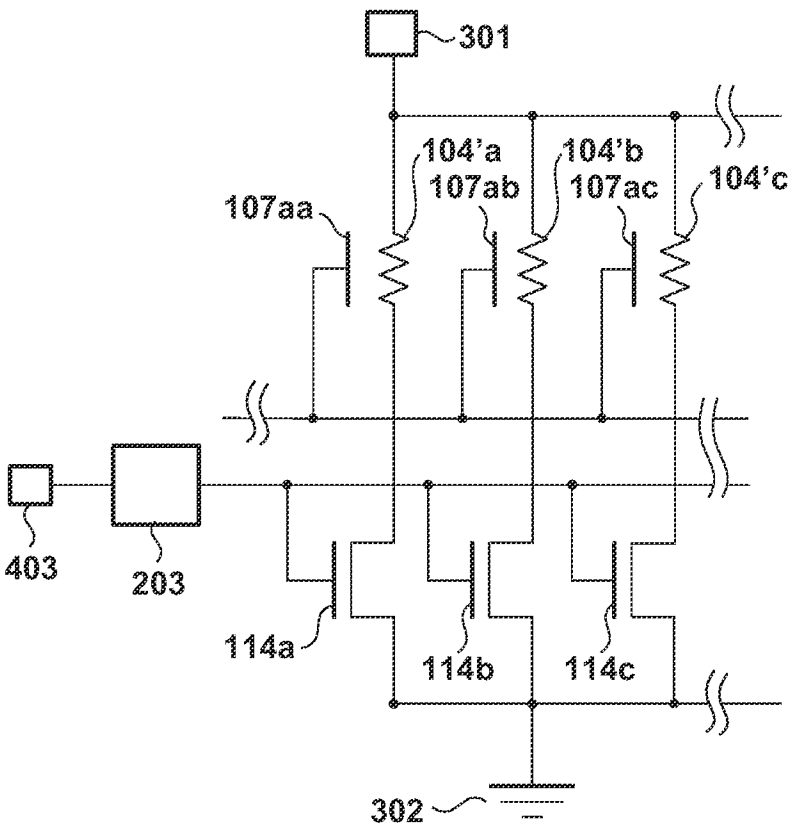

When the heat generating element 104' and the upper protection layer 107 are short-circuited owing to a random failure caused by some reason during printing, the surface potential of the upper protection layer 107 rises. FIGS. 6A and 6B are circuit diagrams before and after short-circuiting in a conventional arrangement. Note that FIGS. 6A and 6B show only part of the circuit arrangement in FIG. 5 and the remaining arrangement is omitted. FIG. 6A shows a state before short-circuiting occurs, and FIG. 6B shows a state after short-circuiting occurs.

When short-circuiting occurs, a voltage is applied to the upper protection layer 107, as shown in FIG. 6B. Even after the random failure, the 24-V power supply voltage is kept applied to the heat generating element 104'. The surface potential of the upper protection layer 107 rises to the 24-V application voltage at a maximum. For example, when the upper protection layer 107 is formed from Ir, the upper protection layer 107 on the heat generating elements 104' except the heat generating element suffering the random failure is eluted into ink, and disconnection may occur in circuits in a plurality of heat generating elements under the influence of the elution.

[Method of Controlling Liquid Discharge Apparatus]

Figure 8:
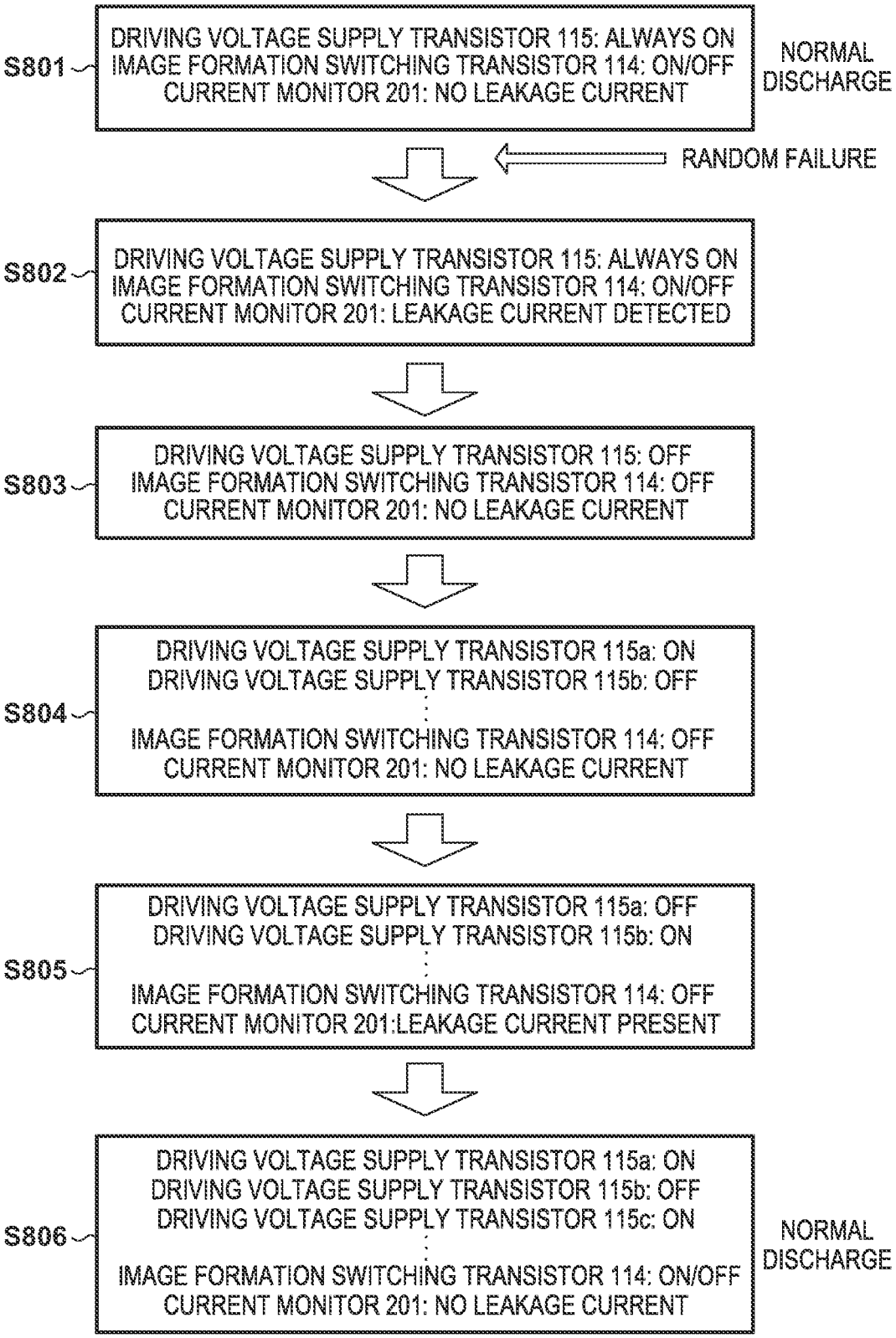
FIG. 8 is a flowchart showing control of the liquid discharge apparatus according to the embodiment.

A method of controlling the liquid discharge apparatus when short-circuiting occurs will be explained as a feature of the present invention with reference to FIG. 8. In this embodiment, control operations along a sequence shown in FIG. 8 are executed. Note that each control operation to be described below is implemented when a signal output from the main body side (for example, the MPU 31) of the liquid discharge apparatus 1 is input from the external connection terminals 402 and 403 to switch each transistor.

The upper protection layer 107 is connected to the GND potential (GND terminal 303) via the current monitor 201. When a random failure occurs and the upper protection layer 107 and the heat generating element 104' are short-circuited, a current flows as shown in FIG. 6B, the potential of the upper protection layer 107 rises, and the current flows through the GND terminal 303. Whether the potential of the upper protection layer 107 rises can be detected by monitoring a current flowing through the GND terminal 303 by the current monitor 201. Note that the presence/absence of the rise (leakage) of the potential may be determined by comparison with a predetermined threshold.

Step S801 represents a state at the time of normal discharge. In this state, the driving voltage supply transistor 115 is always ON. The image formation ON/OFF of the image formation switching transistor 114 has been switched in accordance with discharge data. Since leakage of a current by a random failure (short-circuiting) has not occurred, the value of the current monitor 201 represents this.

Step S802 shows a state when the upper protection layer 107 and the heat generating element 104' are short-circuited along with generation of a random failure (FIG. 6B). The rise of the potential of the upper protection layer 107 is confirmed from the current monitor 201.

In step S803, the image formation switching transistor 114 is switched OFF to stop image formation. Further, the driving voltage supply transistor 115 is switched OFF to control not to supply power to the upper protection layer 107. As a result, no voltage is applied to the heat generating element 104', no leakage occurs, and the value of the current monitor 201 represents that no leakage has occurred. At this stage, short-circuiting may occur between the heat generating elements 104' that are connected to the upper protection layers 107*a* and all the connected upper protection layers 107*a*, and a short-circuited portion has not been specified yet.

To specify the short-circuited portion, control operations in steps S804 and S805 are performed. In this embodiment, a plurality of driving voltage supply transistors 115 are provided. While the driving voltage supply transistors 115 are turned on sequentially, the leakage portion is specified by monitoring a current flowing through the GND terminal 303 by the current monitor 201. That is, inspections in steps S804 and S805 are performed in accordance with the number of driving voltage supply transistors 115. The time in which the driving voltage supply transistor 115 is ON is 0.1 sec equal to or shorter than the time in which the upper protection layer 107*b* made of Ir elutes. Note that the ON time may be changed in accordance with the material of the upper protection layer 107*b*.

The heat generating element 104' in which the leakage has occurred is specified from the value of the current monitor 201. In the example of FIG. 8, it can be specified that the leakage has occurred in the heat generating element 104' corresponding to the driving voltage supply transistor 115*b* among the driving voltage supply transistors 115. As described above, this embodiment adopts the arrangement in which one driving voltage supply transistor 115 controls application of a voltage to three heat generating elements 104'. When the leakage is detected, it has occurred in one of the three heat generating elements 104' in actuality.

After specifying the leakage portion, it is controlled to stop supply of the power supply voltage to the leakage portion in liquid discharge, as represented by step S806. The normal discharge operation can therefore be performed except for the portion where the leakage has occurred.

When a given driving voltage supply transistor 115 detects a leakage, the inspection for the remaining driving voltage supply transistors 115 may continue or may end. For example, whether to continue or end the inspection may be determined in accordance with the value of the current monitor 201 that has detected a leakage in step S802. More specifically, a predetermined threshold is set for a value detected by the current monitor 201, and the number of portions at which a leakage has occurred may be estimated in accordance with a value detected in step S802. When specifying the leakage portion, the continuation/end may be switched based on the estimation result.

If a given driving voltage supply transistor 115 is turned off in step S806, no discharge is performed from the position of the heat generating element 104' corresponding to the driving voltage supply transistor 115. In this case, it is controlled to continue image formation by performing discharge using the heat generating element 104' at another position. A conventional method can be used for this control operation and a detailed description thereof will be omitted.

As described above, according to this embodiment, even when a heat generating element is damaged by a random failure in a pattern in which a plurality of anti-cavitation layers are connected, the quality change and elution of the anti-cavitation layers can be suppressed and the influence on a peripheral portion can be suppressed.

In addition, even when a heat generating element is damaged by a random failure, the discharge operation by the remaining portions can be continued while specifying the failure position.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-174187, filed on Sep. 18, 2018, which is hereby incorporated by reference herein in its entirety.

What is claimed is:

1. A liquid discharge apparatus comprising:

a plurality of heat generating elements configured to heat a liquid in order to discharge the liquid;

a plurality of anti-cavitation layers formed to cover the heat generating elements at positions where the anti-cavitation layers contact the liquid;

a monitoring unit configured to detect a current flowing through the anti-cavitation layers;

a switching section comprised of a plurality of switching units configured to switch whether to apply, to the heat generating elements, a voltage for driving the heat generating elements; and a control unit configured to send a signal to the switching section and control switching of the switching units, wherein in a case that the monitoring unit detects that a current greater than a predetermined value has flowed through one of the anti-cavitation layers while the voltage is applied to the heat generating elements, the control unit sequentially switches the plurality of switching units, so as to identify the heat generating element corresponding to the anti-cavitation layer through which the current has flowed, among the heat generating elements.

2. The apparatus according to claim 1, wherein a correspondence between the switching units and the heat generating elements is one to N (N>1).

3. The apparatus according to claim 1, wherein the anti-cavitation layers are connected to a GND (ground) terminal to be set at a GND potential, and the monitoring unit detects a current flowing through the GND terminal.

4. The apparatus according to claim 1, further comprising:

a liquid discharge head including the heat generating elements, the switching section, and orifices configured to discharge the liquid; and an apparatus main body connected to the liquid discharge head, including the monitoring unit and the control unit, and configured to supply the voltage to the heat generating elements.

5. The apparatus according to claim 1, wherein after the control unit sequentially switches the plurality of switching units, the control unit sends a signal to the switching section, so as not to apply the voltage to the heat generating element corresponding to the anti-cavitation layer through which the current greater than the predetermined value has flowed.

6. The apparatus according to claim 5, wherein the plurality of switching units suppresses applying the voltage to all of the heat generating elements (i) after the monitoring unit detects that the current greater than the predetermined value has flowed through one of the anti-cavitation layers while the voltage was applied to the heat generating elements, and (ii) before the control unit sends, to the switching section, the signal not to apply the voltage to the heat generating element corresponding to the anti-cavitation layer through which the current greater than the predetermined value has flowed.

7. A method of controlling a liquid discharge apparatus including a plurality of heat generating elements configured to heat a liquid in order to discharge the liquid; a plurality of anti-cavitation layers formed to cover the heat generating elements at positions where the anti-cavitation layers contact the liquid; a monitoring unit configured to detect a current flowing through the anti-cavitation layers; a switching section comprised of a plurality of switching units configured to switch whether to apply, to the heat generating elements, a voltage for driving the heat generating elements; and a control unit configured to send a signal to the switching section and control switching of the switching units, the method comprising:

in a case that the monitoring unit detects that a current greater than a predetermined value has flowed through one of the anti-cavitation layers while the voltage is applied to the heat generating elements, causing the control unit to sequentially switch the plurality of switching units, so as to identify the heat generating element corresponding to the anti-cavitation layer through which the current has flowed, among the heat generating elements.

8. The method according to claim 7, further comprising:

causing the control unit to switch the plurality of switching units, after the control unit sequentially switches the plurality of switching units, so as not to apply the voltage to the heat generating element corresponding to the anti-cavitation layer through which the current greater than the predetermined value has flowed.

9. The method according to claim 8, further comprising:

causing the control unit to switch the plurality of switching units so as to suppress applying the voltage to all of the heat generating elements (i) after the monitoring unit detects that the current greater than the predetermined value has flowed through one of the anti-cavitation layers while the voltage was applied to the heat generating elements, and (ii) before the control unit sends, to the switching section, the signal not to apply the voltage to the heat generating element corresponding to the anti-cavitation layer through which the current greater than the predetermined value has flowed.

* * * * *